United States Patent [19]

Payne et al.

[11] 4,139,334

[45] Feb. 13, 1979

[54] CABLE STRING FOR DOWNHOLE PUMPS

[76] Inventors: Bobby L. Payne; Hilary H. Iglehard, both of 5012 Andrews Hwy., Odessa, Tex. 79762

[21] Appl. No.: 772,465

[22] Filed: Feb. 28, 1977

[51] Int. Cl.[2] ..... F04B 21/04; F16J 15/18; F21B 27/00

[52] U.S. Cl. ..... 417/545; 92/165 R; 403/185; 403/220; 166/176

[58] Field of Search ..... 417/545–554; 92/165, 137; 403/185, 220, 41; 166/176

[56] References Cited

U.S. PATENT DOCUMENTS

| | | | |
|---|---|---|---|
| 368,016 | 8/1887 | Schrankel | 92/137 |
| 956,346 | 4/1910 | Heeter | 417/554 |
| 1,002,448 | 9/1911 | Putnam | 403/220 |
| 1,721,245 | 7/1929 | Black | 92/137 |
| 2,793,917 | 5/1957 | Ward | 166/176 |
| 3,013,793 | 12/1961 | Howell | 403/220 |
| 3,471,904 | 10/1969 | Aho | 403/185 |
| 3,490,526 | 1/1970 | Collett | 166/176 |
| 3,889,579 | 6/1975 | Wiechowski | 417/545 |
| 3,965,802 | 6/1976 | Jacobs | 92/137 |

*Primary Examiner*—William L. Freeh
*Attorney, Agent, or Firm*—Marcus L. Bates

[57] ABSTRACT

A cable string for replacement of a prior art sucker rod string used in pumping oil wells with a pump jack unit. The cable string is comprised of a plurality of individual joints of multi-strand material connected together by a coupling member. Each individual joint has a pin member at each extremity thereof. Each joint is affixed in series relationship to another joint by the coupling member. The coupling member has a box connection at each extremity thereof. Hence, the pin member of adjacent joints are connected together by the box connection of the coupling member to provide a string of flexible cable joints of sufficient length to extend from proximity of the pump jack downhole through the borehole into proximity of the downhole pump. When a plurality of cable joints are connected together, the resulting length thereof is equivalent to the length of a standard solid metal joint of sucker rod.

8 Claims, 9 Drawing Figures

CABLE STRING FOR DOWNHOLE PUMPS

BACKGROUND OF THE INVENTION

Many oil wells must be pumped by locating a pump jack unit above the surface of the ground and operatively connecting said unit to a downhole pump by employment of a sucker rod string. The prior art sucker rod string is made up of a plurality of joints of solid metal rod which are either twenty-five or thirty feet in length, depending upon the geographical location of the oil field.

The oil bearing strata of the borehole may be located as much as several thousand feet below the surface of the earth and the sucker rod string therefore may be more than a mile in length. Accordingly, the weight of this quantity of sucker rod may be several thousands of pounds.

Boreholes are usually crooked for they corkscrew or spiral rather than extend precisely vertical because of the inherent problems associated with drilling. Accordingly, the sucker rods must be made relatively flexible so that the rod string can conform to the spiraling production tubing.

Since all boreholes inherently deviate a substantial amount from the vertical, the exterior of the sucker rod frequently contacts and rubs the production tubing at spaced, marginal, interior portions thereof, depending upon the amount of deviation. One prior art expedient which may be employed to reduce this undesirable problem associated with production is the provision of guide means attached to the rods. For example, Wolfe, U.S. Pat. No. 3,510,234 and Collett, U.S. Pat. No. 3,490,526, propose a guide means for reducing the wear between the rod and the interior of the production tubing.

Others have approached this wear problem by reducing the weight of the sucker rod string by employment of a single length of reinfored plastic as exemplified by Wiechowski, U.S. Pat. No. 3,889,579.

Wire rope and fittings therefor are known to those skilled in the art as evidenced by the patents to Trier et al., U.S. Pat. No. 3,100,924 and Matthews, U.S. Pat. No. 1,863,021. Reference is made to the above cited U.S. Patents as well as to the art of record therein for further background of this invention.

It would be desirable to have made available an actuating string for a downhole pump which is considerably reduced in weight, which is extremely flexible and accommodates itself to the deviation of a hole without suffering the deleterious effects normally associated with repeated bending moments, and which includes spaced guide means thereon for reducing the wear normally effected between the rod string and the interior wall of the production tubing.

SUMMARY OF THE INVENTION

This invention relates to oil production and specifically to a cable string for replacement of a sucker rod string of the prior art, comprising, a plurality of individual joints of multistrand material connected together by coupling members. Each joint has a pin member at each end thereof. The coupling member includes a box at each end thereof for threadedly engaging the pin member of adjacent joints so that the individual joints can be series connected to provide a cable string of sufficient length to extend from proximity of a pump jack unit into proximity of a downhole pump. The coupling member and two pin members are cylindrical in form and larger than the cable so that they jointly cooperate together to provide a guide member for slidable engagement with the interior of the tubing wall.

The length of each joint is of a value which enables the resultant structure to present a guide means at optimum spaced distances along the length of the entire borehole. The guide means are preferably spaced apart from one another at selected locations which prevent the cable located therebetween from contacting the inside surface of the tubing.

This expedient greatly reduces the wear between the cable string and the inside peripheral wall surface of the tubing. The reduction in weight further reduces the wear rate while the reduction in size increases the flow rate through the tubing string.

A primary object of this invention is the provision of method and apparatus for reducing the wear between the tubing string and rod string occasioned by the deviation of a borehole of an oil well.

Another object of this invention is to provide improvements in a sucker rod string for use downhole in a borehole.

A further object of this invention is to provide an improved cable string for a pumped well which is lightweight and includes spaced enlargements thereon in the form of coupling members which are spaced apart an amount to prevent the intervening cable from wearing against the inside wall of the tubing.

Another and still further object of the invention is to provide improvements in a cable string for actuating a downhole pump wherein the cable string is made of spaced cable lengths connected together by an enlargement which serves the dual function of a coupling member as well as a guide member.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENTS

Figure 1:
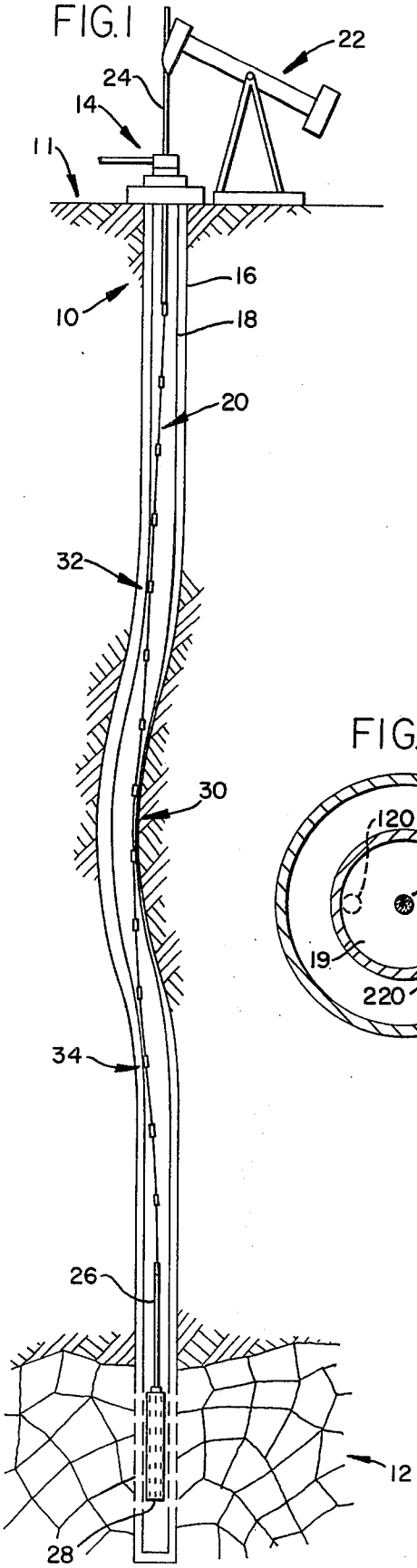
FIG. 1 is a diagrammatical, cross-sectional representation of a borehole.

FIG. 1 discloses a borehole 10 which extends from the surface 11 of the earth down to an oil bearing formation 12. A well head 14 is affixed to a casing 16, while a production tubing 18 is concentrically arranged therewithin in the usual manner.

A cable string 20, made in accordance with the present invention, has an upper end thereof attached to a pump jack unit 22. The pump jack unit includes the usual polish rod 24 for reciprocating the cable string. The lower end of the cable string is provided with a plurality of sinker bars at 26 for maintaining the cable string in proper tension. A downhole pump 28 is reciprocated as the pump jack unit moves the cable string. Hence, the production unit of FIG. 1 is of conventional design except for the cable string 20 of the present invention.

Figure 2:
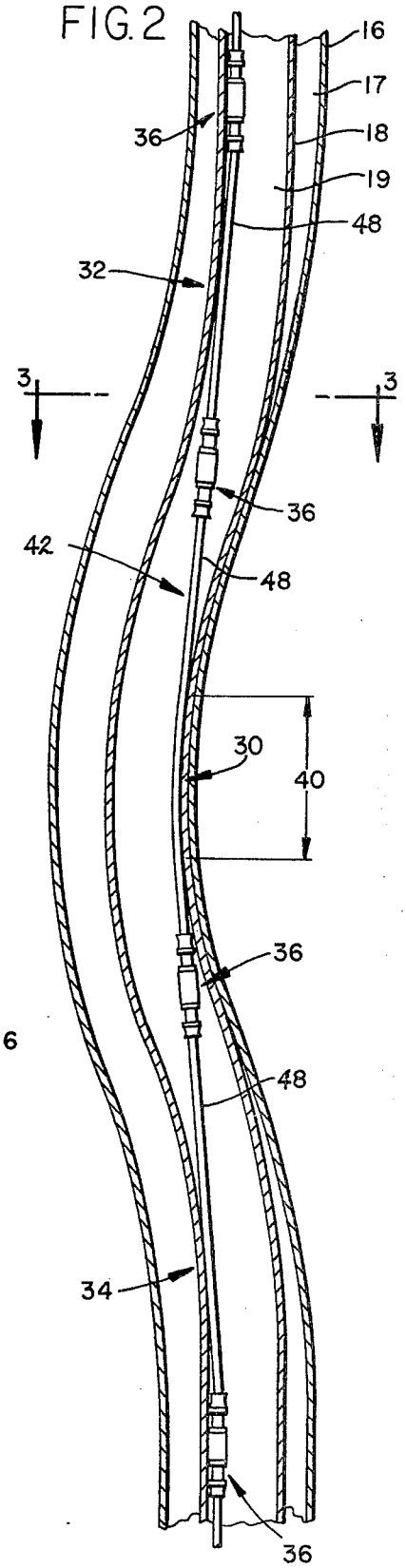
FIG. 2 is a fragmented enlargement of part of the borehole disclosed in FIG. 1, with a prior art rod string being disposed therein.

As noted in FIGS. 1 and 2, the borehole deviates from the vertical and corkscrews or spirals along its length thereby causing any string associated therewith to rub the tubing interior as indicated by the numerals at 30, 32, and 34. As seen in the prior art illustration of FIG. 2 and FIG. 4, the prior art rod string 42 is comprised of a plurality of individual joints 48 connected together at their extremities by coupling member 36. Hence, a plurality of individual rods 48 is series connected to one another by coupling member 36 to form a conventional prior art rod string which extends from proximity of the pump jack down to the bottom hole pump.

Numeral 40 indicates the continuous length of the production tubing which can be contacted by any rod or cable string as a result of the deviation usually encountered in a borehole.

Figure 3:
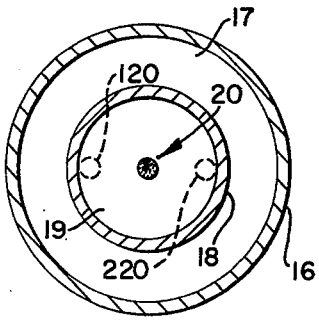
FIG. 3 is an enlarged, cross-sectional view taken along line 3—3 of FIG. 2.

In FIG. 3 the casing 16, production tubing 18, and rod string 20 are ideally positioned respective to one another. The dot-dash numerals 120 and 220 illustrate the undesirable rod position 32 and 30, respectively, of high wear as shown in association with FIG. 2.

Figure 4:
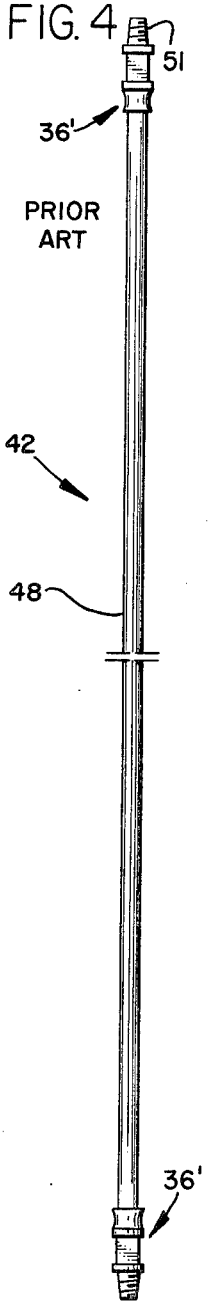
FIG. 4 is a side elevational view of a prior art sucker rod.

FIG. 4 discloses a rod string 42 which includes a prior art joint 48 of sucker rod. The reduced diameter central part of the rod is attached at opposed ends to pin members at 36'. The opposed pins are spaced apart a standard length of either twenty-five or thirty feet. This spacing is to conform to local customs, as for example, the Texas Permian Basin spacing is twenty-five feet whereas in California the spacing is thirty feet.

Figure 5:
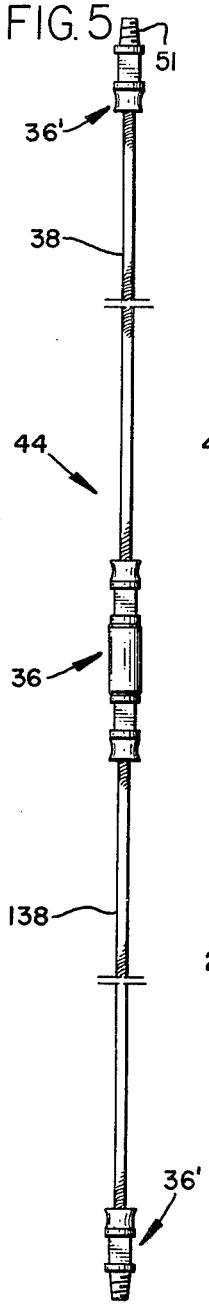
FIGS. 5 and 6, respectively, set forth different embodiments of the apparatus made in accordance with the present invention.

FIG. 5 discloses a stand 44 made up of two joints of cable members according to the present invention. The series connected cable lengths 38 and 138 have the two adjacent pin members 36' thereof connected to one another by the illustrated coupling member 36. The opposed pin ends 36' extend away from one another a distance equal in length to a standard twenty-five foot joint of sucker rod.

Figure 6:
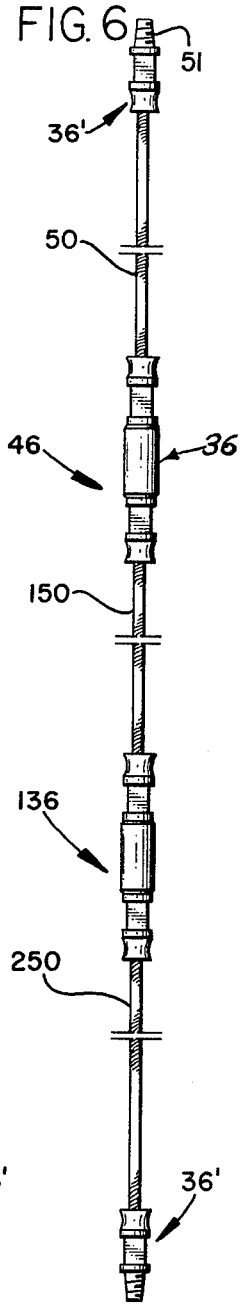

FIG. 6 discloses a stand 46 comprised of three series connected joints 50, 150, 250 of cable members made in accordance with the present invention. The joints are connected together by coupling members 36 and 136. The pin ends 36' at each extremity thereof are spaced a distance which is equivalent to a standard thirty foot joint of sucker rod.

Figure 7:
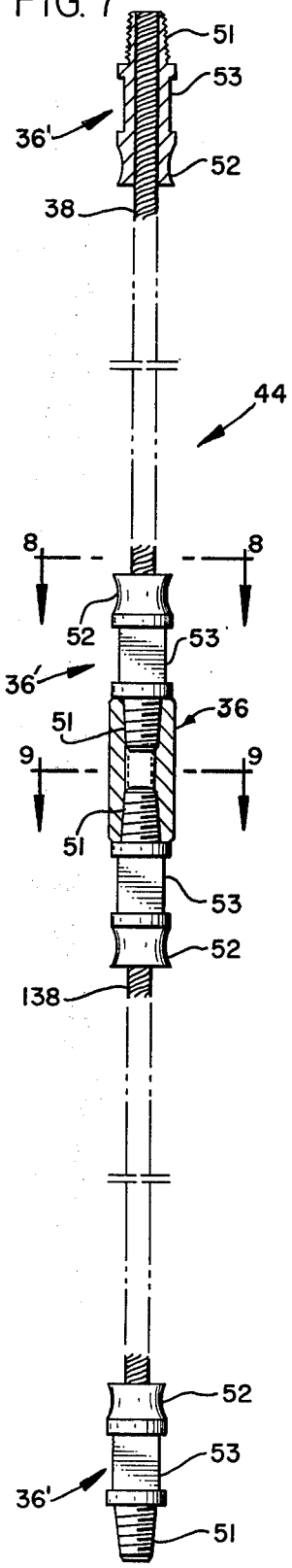
FIG. 7 is an enlarged, part cross-sectional, side elevational view of two joints of cable rod made in accordance with the present invention.

FIG. 7 illustrates the more specific details of the embodiment of the invention previously disclosed in FIG. 5. As seen in FIG. 7, the opposed pin ends 36' include a threaded end 51 and a cable receiving end 52. Wrench flats are formed at 53 so that the pins can be suitably made up with the opposed box ends of a coupling member 36. Each length or joint of the cable 38 is therefore provided with an upper and a lower pin connection 36'.

Figure 8:
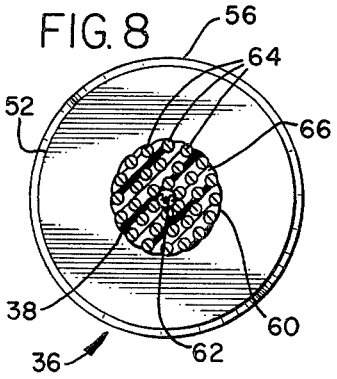
FIG. 8 is an enlarged, cross-sectional view taken along line 8—8 of FIG. 7.

As seen in FIG. 8, the cable member 38 may be provided with an exterior surface 60 comprised of a smooth protecting material, such as polyester, and a core 62, about which there is placed individual strands of material 64. The space 66 between the individual strands 64 preferably is filled with protective material such as polyester. The strands 64 can be spiraled about the center core 62 or they may be arranged parallel to the longitudinal axial centerline thereof. The material of construction of the strands may be of steel, fiberglass, polyester, or other suitable materials.

In operation, the pump jack unit 22 reciprocates a polish rod 24 causing the string of cable members 20 to reciprocate a downhole pump 28. In order to maintain the string of the present invention in proper tension on both the up and down stroke, a number of sinker bars 26 are incorporated into the lower extremity of the string in order to provide concentrated weight on the lowermost end of the string. Accordingly, the term "extends from a pump jack unit to a downhole pump" is intended to mean that the cable string is connected so as to impart motion from the pump jack unit down to the downhole pump, with there being a polish rod or the like at the upper extremity thereof and a sinker bar or the like at the lower end thereof to facilitate operation of the pumping mechanism.

At various different elevations within the borehole, deviation, such as diagrammatically illustrated in FIGS. 1 and 2 by the numeral 30, will be encountered. Such deviation offers three areas of contact 30, 32, and 34 between the cable string and the interior surface of the tubing.

As seen in FIG. 2, there is a minimum length 40 presented by the interior surface of the production tubing which may be contacted by a rod string. According to this invention, placement of a connector 36 or 136 such that it reciprocates within the length 40 prevents the cable length 38 or 50, for example, from touching any portion of the interior of the production tubing located within the marginal length 40 thereof. Similarly, the coupling member 36 or 136 located along the area of the wall at 32 and 34 likewise prevent the cable from rubbing the interior surface of the production tubing.

The Applicants have discovered that a standard twenty-five foot length of a joint of sucker rod frequently exceeds the length 40 of FIG. 2 and accordingly, the reduced diameter mid-portion of the rod will often be placed within area 40 with the end connections thereof being placed at a location outside of the marginal length 40. With this undesirable arrangement, the reduced diameter portion of the sucker rod rubs against the interior of the production tubing and soon abrades a hole therein. Furthermore, this undesirable action imparts a bending motion into the rod joint which travels up and down the joint with each cycle of reciprocation thereby bringing about early failure of the rod. This action is evidenced as fatigue failures which occur along the shoulder where the rod diameter increases into the pin end as well as by body wear on the rod.

Applicants contribution overcomes the above prior art deficiencies by placing a coupling 36 and 136 so that it usually is spaced such that it must reciprocate within the minimal distance indicated by numeral 40, no matter how the strings are placed within the borehole. This novel and unexpected result is illustrated in FIG. 1. Moreover, the flexible cable 38 can withstand the various different bending moments brought about by the crookedness of the hole thereby obviating failure near the pin ends of each individual joint. Furthermore, the enlargement presented by the pins and coupling members usually engages the interior side wall of the produciton tubing so that a greatly increased bearing area is effected therebetween as compared to the heretofore rubbing of the reduced diameter portion of a joint of prior art sucker rod thereagainst.

As noted in FIGS. 5 and 6, together with FIG. 4, Applicants' cable joints can be made up into conventional lengths which are equal to the usual standard rod length of either 25 or 30 feet, as presently used throughout the industry. This desirable expedient enables a standard workover rig to conveniently handle the novel cable joints of the present invention without encountering the problems presented by excessive stand lengths or the drawbacks which may be associated with short stands of cable joints.

Figure 9:
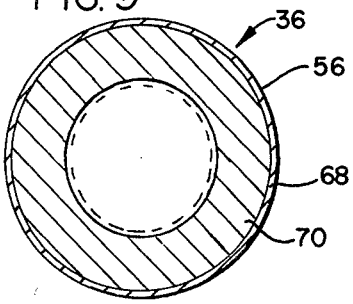
FIG. 9 is a cross-sectional view taken along line 9—9 of FIG. 7.

In FIG. 9, applicants provide their coupling members and pin ends with a coating 68 of a sprayed metal in accordance with the previously filed patent application, Ser. No. 682,380. The sprayed metal protects the main body 70 of the coupling 36 and furthermore provides a low-friction contact at the inside peripheral wall surface of the tubing.

The cable lengths 38 are made of steel rope, fiberglass, polyester, or other material. The individual strands 64 thereof may be either straight monofilaments or woven cords having any desired twist. The cable strands which are wound about the center of the core preferably are affixed to one another with the twist of alternant joints being arranged in opposite directions as indicated in FIG. 7 at 38 and 138. This expedient reduces the tendency of imparting axial rotation into the opposed ends of the cable rod string.

The flexible cable member of this invention avoids torsional forces which heretofore tend to break rod strings. The cable string of the present invention will weigh less than a conventional rod string and therefore will greatly reduce the power required of the pump jack unit as well as reducing frictional wear between the couplings and the tubing wall. The entire cable string and couplings can be made smaller than conventional similiar devices because of the strength-weight ratio of the cable rod string.

We claim:

1. In an oilwell having a borehole within which a downhole pump is positioned, a pump jack located on the surface of the ground, and a sucker rod string extending downhole through the borehole by which the pump jack reciprocates the pump, the improvement comprising:

said sucker rod string comprising a plurality of individual joints of multi-strand material, means forming a pin member at each end of each said joint such that the terminal end of each said joint of multi-strand material is affixed to one said pin member;

a coupling member having a box member at each end thereof which threadedly engages a pin member of adjacent joints so that the joints can be series connected to provide a rod string of sufficient length to extend from proximity of the pump jack into proximity of the pump; the length of each said joint is at least ten feet and no more than twelve and one half feet;

said coupling member is of a diameter which is at least twice the diameter of said multi-strand material, and having a length which is substantially greater than said diameter so that the outer periphery of said coupling member forms a wearing surface which prevents the multi-strand material from wearing against the inside peripheral surface of the wellbore.

2. The improvement of claim 1 wherein said multi-strand material is nonmetallic.

3. The improvement of claim 1 wherein said multi-strand material is steel.

4. The improvement of claim 3 wherein said sucker rod string has an upper end connected to a polish rod and a lower end connected to a sinker bar so that the pump jack reciprocates the polish rod which reciprocates said rod string, said sinker bar has a lower end thereof connected to the downhole pump for reciprocation thereof so that said sinker bar maintains tension in said rod string at all times.

5. In an oilwell having a pump jack unit which reciprocates a string of sucker rods located in the borehole thereof, the sucker rods being connected to reciprocate a downhole pump so that production can occur up through a production tubing within which the sucker rod is located, the improvement comprising:

said string of sucker rods being made of a plurality of series connected individual joints, each individual joint having an upper pin connection, a lower pin connection, and a cable means having marginal, terminal ends attached to said upper and lower pin connections;

a sub by which each pin of adjacent joints is connected together;

the length of said cable means and said upper and lower pin connections being of a value wherein said subs are spaced at least ten feet and no more than twelve and one half feet apart from one another;

said sub being of a diameter which is at least twice the diameter of said cable means; said sub also having a length which is substantially greater than said diameter, so that the outer peripheral surface of said sub forms a wearing surface respective to the inside peripheral wall surface of the production tubing such that the cable is maintained spaced therefrom, thereby preventing wear from occurring between the cable means and the nearest adjacent surface of the wellbore.

6. The improvement of claim 5 wherein said multi-strand material is non-metallic.

7. The improvement of claim 5 wherein said multi-strand material is steel.

8. The improvement of claim 7 wherein said sucker rod string has an upper end connected to a polish rod and a lower end connected to a sinker bar so that the pump jack reciprocates the polish rod which reciprocates said rod string; said sinker bar has a lower end thereof connected to the downhole pump for reciprocation thereof, said sinker bar maintains tension in said rod string at all times.

* * * * *